US008322059B2

(12) United States Patent
Henshaw

(10) Patent No.: US 8,322,059 B2
(45) Date of Patent: Dec. 4, 2012

(54) ATHLETIC INFORMATION DISPLAY

(75) Inventor: Graham Henshaw, Arlington, VA (US)

(73) Assignee: Sporting Innovations Group, LLC, Atlanta, GA (US)

( * ) Notice: Subject to any disclaimer, the term of this patent is extended or adjusted under 35 U.S.C. 154(b) by 89 days.

(21) Appl. No.: 12/529,313

(22) PCT Filed: Nov. 14, 2007

(86) PCT No.: PCT/US2007/023885

§ 371 (c)(1),
(2), (4) Date: Jan. 27, 2010

(87) PCT Pub. No.: WO2008/108837

PCT Pub. Date: Sep. 12, 2008

(65) Prior Publication Data

US 2010/0139854 A1 Jun. 10, 2010

Related U.S. Application Data

(60) Provisional application No. 60/893,038, filed on Mar. 5, 2007.

(51) Int. Cl.
*G09F 21/02* (2006.01)

(52) U.S. Cl. ..... 40/586

(58) Field of Classification Search ..... 40/586
See application file for complete search history.

(56) References Cited

U.S. PATENT DOCUMENTS

| | | | | |
|---|---|---|---|---|
| 5,052,418 | A | 10/1991 | Miller | |
| 5,578,353 | A | 11/1996 | Drew, III | |
| 5,939,142 | A | 8/1999 | Comiskey et al. | |
| 6,042,881 | A * | 3/2000 | Ewan | 427/152 |
| 6,231,952 | B1 | 5/2001 | Lipper | |
| 6,742,817 | B2 * | 6/2004 | Timlin | 283/67 |
| 6,793,999 | B2 | 9/2004 | Wittmeyer, Jr. | |
| 6,857,935 | B1 | 2/2005 | Dohan | |
| 6,964,229 | B1 * | 11/2005 | Zimmerman | 101/483 |
| 7,011,401 | B2 | 3/2006 | Markey, III | |
| 2005/0258635 | A1 * | 11/2005 | Dominguez | 283/74 |
| 2010/0180751 | A1 * | 7/2010 | Diakoulas | 84/477 R |

FOREIGN PATENT DOCUMENTS

KR 10-2003-0008510 A 1/2003

OTHER PUBLICATIONS

Office Action dated Nov. 22, 2010 for co-pending U.S. Appl. No. 11/985,307.
Amendment to Office Action dated Nov. 22, 2010 for co-pending U.S. Appl. No. 11/985,307.

(Continued)

*Primary Examiner* — Gary Hoge
(74) *Attorney, Agent, or Firm* — Brient Intellectual Property Law, LLC

(57) ABSTRACT

A product and method for displaying athletic data and certain information on skin is described. Said information being, but not limited to, an athlete's pacing goals for an athletic event, a course map, or other event information helpful to an athlete while competing in an athletic event. Said information preferably being displayed in the form of a temporary tattoo that can be applied to an athlete's skin so that the information is readily available and convenient to use during the event.

11 Claims, 6 Drawing Sheets

OTHER PUBLICATIONS

Final Office Action dated Apr. 8, 2011 for co-pending U.S. Appl. No. 11/985,307.

Office Action of U.K. Intellectual Property Office dated Apr. 1, 2011 for co-pending U.K. Application No. GB0915406.3.

Stick to Your Pace!, dated Sep. 3, 2007, http://replay.waybackmachine.org/20070903044750/http://www.pacetat.com/.

Office Action dated Sep. 28, 2011 for co-pending U.S. Appl. No. 11/985,307.

Advisory Action dated Jul. 20, 2011 for co-pending U.S. Appl. No. 11/985,307.

Amendment to Final Office Action dated Apr. 8, 2011 for co-pending U.S. Appl. No. 11/985,307.

Response dated Jul. 29, 2011 to U.K. Intellectual Property Office Action dated Apr. 1, 2011 for co-pending U.K. Application No. 0915406.3.

Office Action of U.K. Intellectual Property Office dated Aug. 12, 2011 for co-pending U.K. Application No. 0915406.3.

* cited by examiner

ATHLETIC INFORMATION DISPLAY

CROSS-REFERENCE TO RELATED APPLICATIONS

This application claims priority on U.S. Provisional Patent Application Ser. No. 60/893,038, filed Mar. 5, 2007.

BACKGROUND

Many athletic events take place in which the participants compete in a timed activity along a predetermined course. Single sport races such as marathons and multi-sport races such as triathlons are examples of these kinds of events. Many participants in these events attempt to complete the activity within a certain elapsed time. This elapsed time corresponds to a desired pace at which the athlete must perform in order to meet the goal. This pace can be represented as the elapsed time between predetermined distances on the course.

Many methods are known to help athletes perform at a particular pace. Some athletes wear watches designed specifically for monitoring their pace through electronic sensing. Another popular method used is known as a pace wristband as described in U.S. Pat. No. 6,742,817—Method of charting a racecourse—Bryan Timlin. A pace wristband is comprised of a piece of paper that is imprinted with a column of distance markers and a corresponding column of accumulated elapsed times. In the instance of a marathon, the pace wristband will include elapsed time data for each of the 26.2 miles of the competition. For example, if an athlete wishes to complete a marathon in four hours, his or her average pace would necessarily be nine minutes and nine seconds per mile, and thus the pace wristband might display the following data; mile 1—00:09:09, mile 2—00:18:18, mile 3—00:27:27, and so on up to 26.2 miles. Athletes typically wear this wristband in a loop around their wrist or carry the wristband on their person in some other manner.

Of relevance to this disclosure is the practice of applying a product to a person's skin. One field of particular relevance is that of temporary tattoos. Such tattoos are described by U.S. Pat. No. 6,042,881—Temporary tattoo and method for manufacturing same—Frederick R. Ewan. The functional use of temporary tattoos beyond ornamental purposes is taught in U.S. Pat. No. 5,578,353—Tattoo admission ticket—James H. Drew, III. U.S. Pat. No. 5,578,353 teaches the advantageous use of temporary tattoos to identify a person having paid admission to an event. Additionally, U.S. Pat. No. 7,011,401—Under-eye anti-glare sport tattoos—Stephen A. Markey, III, teaches the use of temporary tattoos as a means for reducing glare associated with the sun or stadium lights while incorporating space for advertising. U.S. Pat. No. 6,964,229—Method for recording multi-event sports meet information on skin—Terri Chassay "T. C." Zimmerman, teaches a method using an ink stamp or a temporary tattoo to produce a means convenient for displaying swim meet event information on a swimmer's skin.

The common methods for displaying athletic performance data such as pace wristbands are cumbersome and require the athlete to carry an additional item with them while they compete which can be impractical in multi-sport competitions where the athlete might swim for a portion of the race or simply bothersome during the course of long event. Other methods such as specially designed pacing watches are expensive, even cost-prohibitive for some. What is needed is a simple, low-cost method to allow athletes access to this relevant event information while not encumbering them with additional paraphernalia that can become bothersome during an event.

SUMMARY

Accordingly, the described product and method presents a means where event performance data or course information is made available to athletes in a non-cumbersome format that eliminates or mitigates some of these shortcomings.

One characteristic of the described product and method is that event performance data or course information can be displayed in the form of a temporary tattoo or other media that is transferable to a person's skin.

An additional characteristic of the described product and method is that event data corresponding to an athlete's desired pace can be displayed.

An additional characteristic of the described product and method is that event information such as a course map can be displayed.

In furtherance of the characteristics mentioned above, a multiplicity of paces can be printed using said tattoo format so that athletes desiring to complete an event at varying paces can take advantage of this product. In one embodiment, a finite number of paces can be available from which an athlete may choose. Another embodiment can provide a means of customizing the pace for an individual and producing a temporary tattoo specific to that pace.

One advantage of the described product and method is that it can be flexible and durable as to maintain it's form and function during the course of an athletic event.

Another advantage of the described product and method is that it can have adhesive properties that resist delamination or other movement while applied to the skin.

Another advantage of the described product and method is that it can be removable after the athlete has made use of the product.

Another advantage of the described product and method is that it can be resilient to water and perspiration.

Another advantage of the described product and method is that it can be resistant to smudging.

Another advantage of the described product and method is that event-specific information such as water stops, medical stations, toilet locations, and other landmarks can be displayed.

Another characteristic of the described product and method is that it can provide a means for advertising by including company logos, trademarks or other identifying matter in the transferred material and/or substrate material.

Another characteristic of the described product and method that the temporary tattoo can also be adhered to a spectator's skin so that those watching or tracking an athlete during an event will be able to enjoy the same benefits described by this disclosure.

Another advantage of the described product and method is that a background color that is in contrast to the color of the race information can be included in the design to increase legibility on a variety of skin tones.

Another advantage of the described product and method is that an alternating background color can be incorporated to increase legibility of each line of information.

Another advantage of the described product and method is that recommended intervals for ingesting nutritional products can be displayed.

Another advantage of the described product and method is that any temporary tattoo method or other means for transferring information to a persons' skin meeting the above-described criteria can be used to create the product.

DETAILED DESCRIPTION

Figure 1:
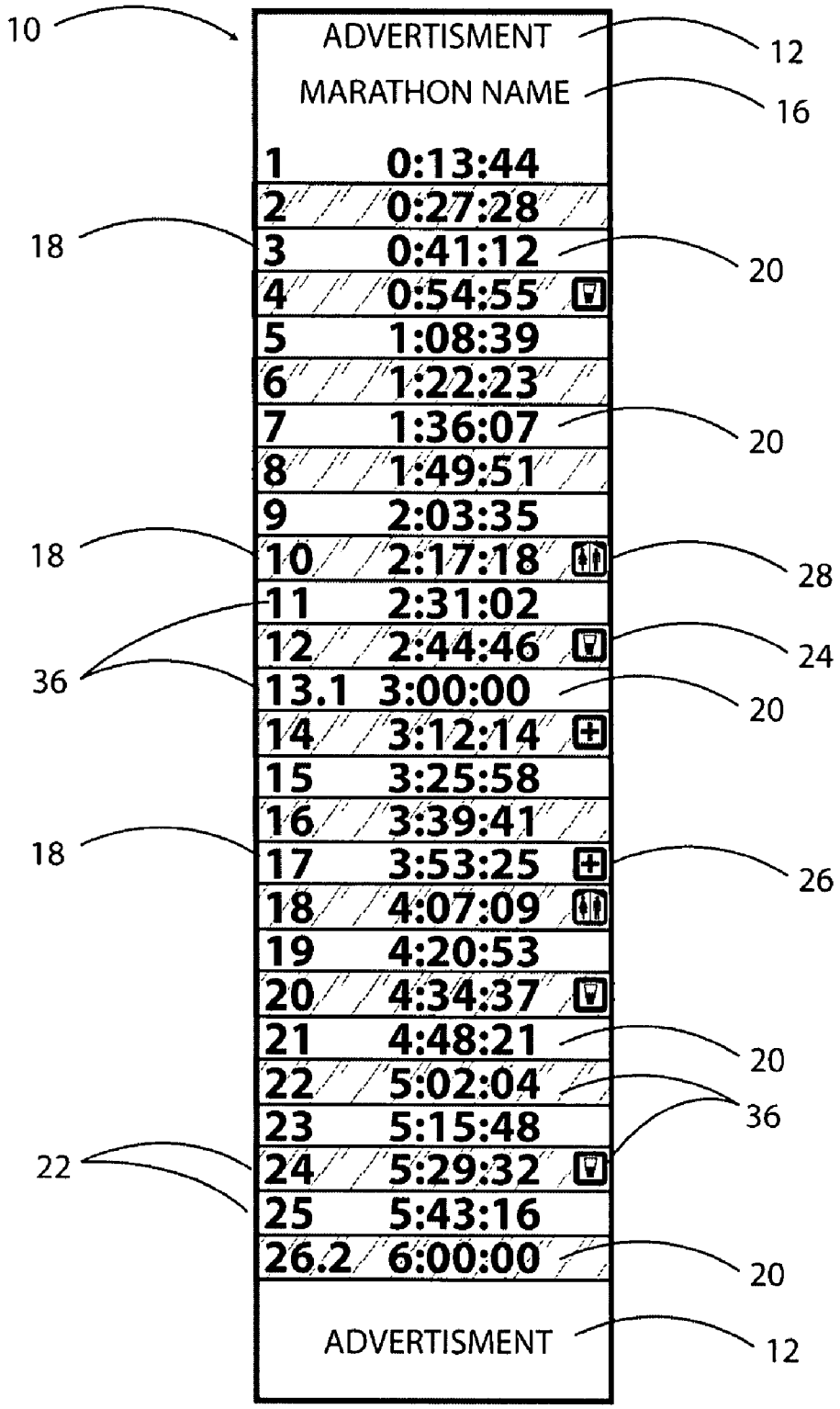
FIG. 1 is a plan view of the described product and method in accordance with the present disclosure as it can appear as applied on a person's skin.
Figure 2:
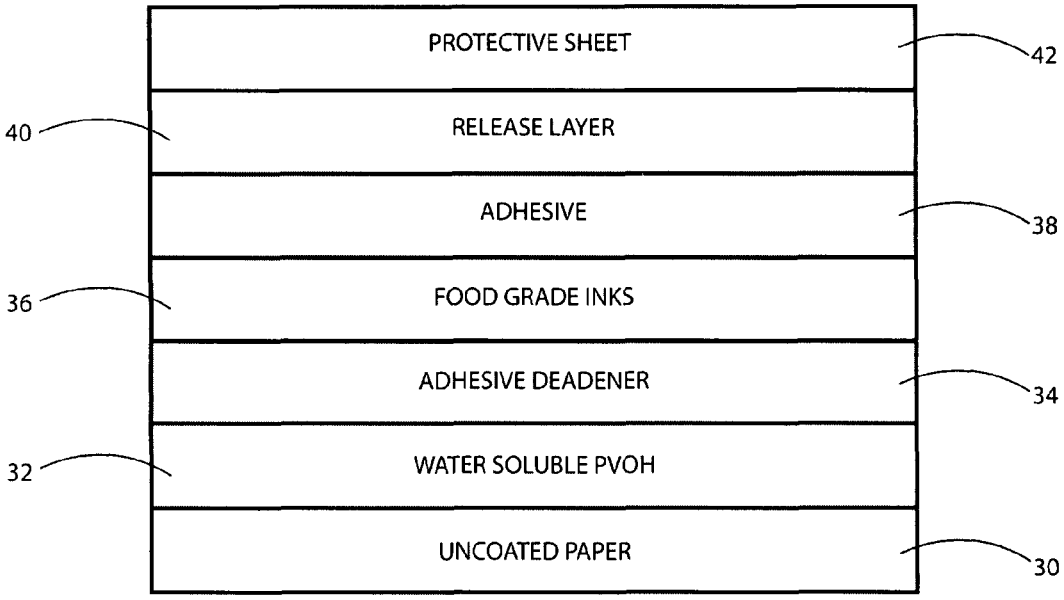
FIG. 2 is a cross-sectional view of the described product and method presented in FIG. 1.
Figure 3:
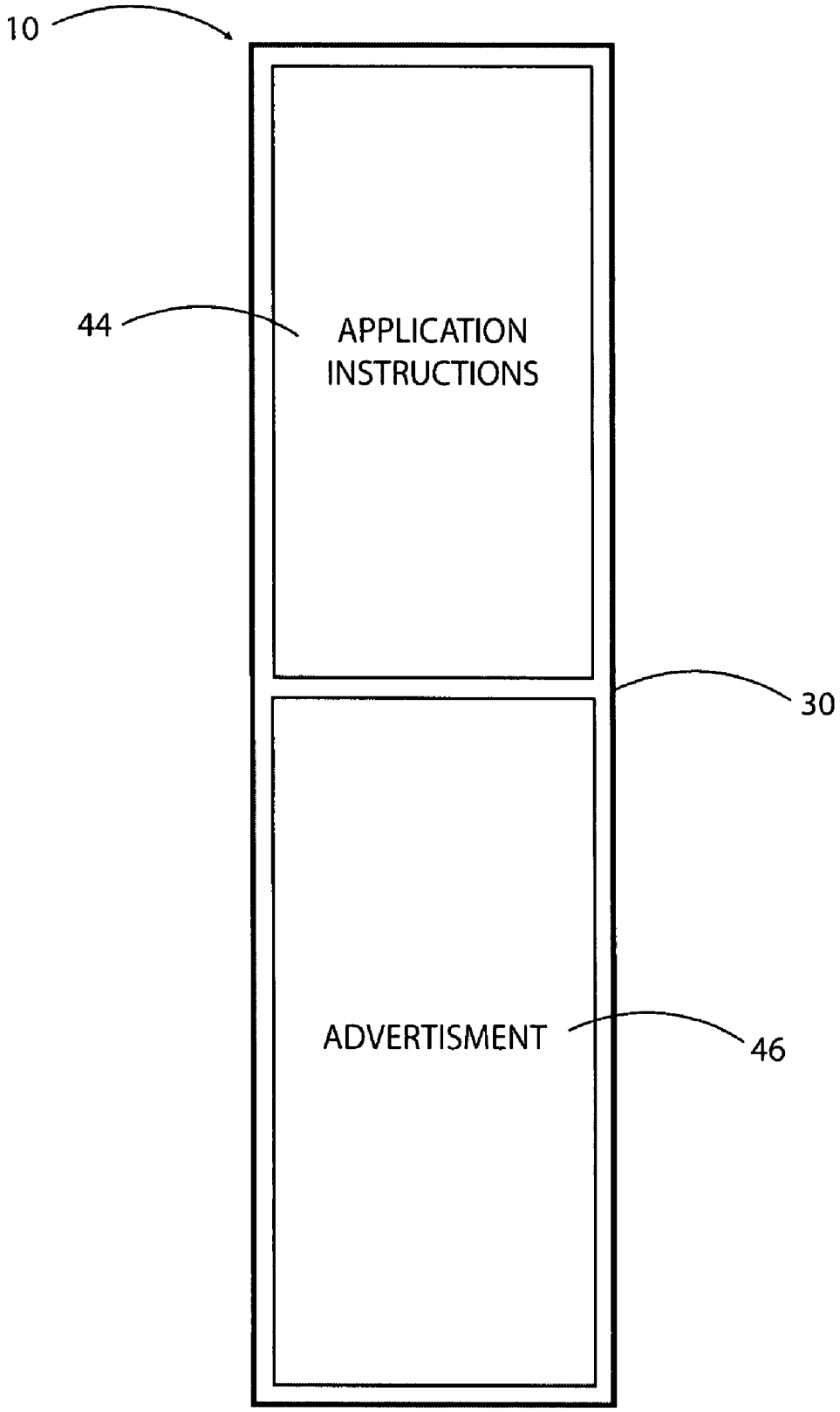
FIG. 3 is a plan view of the reverse side of the described product and method in accordance with the present disclosure.

One embodiment of the described product and method and the components of said product and method are illustrated in FIG. 1, FIG. 2, FIG. 3 of the drawings. The components of the drawings are not necessarily drawn to scale and have been illustrated as such to emphasize the principles of the described product and method. For the purpose of this description, pace information corresponding to a six-hour marathon has been illustrated. Also for the purpose of this description, FIG. 1 is depicted as applied on a person's skin in the case of the preferred embodiment. It should be noted, that the preferred embodiment of the product (10) is a temporary tattoo that in its packaged form the image will appear reversed in order to correctly display the information when transferred to the athlete's skin. The principles described apply to other embodiments of the described product and method as well.

As shown in FIG. 1, the described product, generally indicated at (10), can provide one or more spaces for advertising (12) at, for example, the first and second ends of the product (10). These areas (12) can be populated with one or more company names or logos or other identifying information. One advantage for makers of the product (10) is that funds can be collected for the privilege of advertising on the areas (12). Information specific to the athletic event such as the name or location of said event can also be included are indicated at (16). It should be noted that the location of the advertising and the event information need not be restricted to these locations.

In the embodiment shown in FIG. 1, uses a matrix type arrangement having one column (18) displaying distance information and another column (20) displaying the accumulated elapsed time information for that distance where each row forms a segment having an elapsed time for a specified distance. The described product can be designed in such a way as to readily correlate the distance and time information for a specific pace. A preferred font size of at least 16 point can be used in order to facilitate legibility while in motion and to allow those with poor eyesight to take advantage of the benefits described herein.

In the embodiment shown in FIG. 1, one method for increasing the legibility of the described product can be to incorporate a background color that is in contrast to the color of the text thereby making the text stand out. Another advantage of using a background color can be to allow the described product to be used by people of various skin tones. Indicated at (22), the background color can be alternated with another contrasting color in order to distinguish each line of information. The combination of contrasting alternating background colors and correspondingly contrasting text color can facilitate legibility of the information while in motion. A preferable color combination can include an alternating black and white background with white text and information on the black background and black text and information on the white background, although any colors of sufficient contrast can be used.

Support stations can also be indicated next to the distance (18) and corresponding elapsed time (20) information. Support stations can include, but are not limited to a water symbol (24), a first aid symbol (26), and a toilet symbol (28). Other support station symbols can include such course information as nutrition stops, and spectator locations. Also, symbols can be used to indicate recommended intervals distances for ingesting nutritional products carried by the athlete during the race.

FIG. 2 shows a cross-sectional view of the temporary tattoo embodiment of the described product (10) to illustrate various exemplary components that can comprise a temporary tattoo. Preferably, as first layer an uncoated paper layer (30) provides a backing for the temporary tattoo. The paper layer (30) is preferably formed with a paper having a high rate of water transmission allowing quick water penetration when the temporary tattoo is being applied. One advantageous aspect of the described product and method can be to include application instructions (44), advertising (46), or other information on the back of the uncoated paper layer (30) as shown in FIG. 3. For example the set of instructions (44) relating to the temporary tattoo (10) of FIG. 3 can include the following:

Pace Tattoo Instructions:

1. Skin should be clean and free of oils & makeup.
2. Remove clear, protective top sheet.
3. Press pace tattoo firmly onto clean, dry skin with design facing down.
4. Hold wet cloth against back of pace tattoo, press down and make sure to wet it thoroughly.
5. Wait 30 seconds—Do not rush. Peel away paper backing.
6. Gently rinse image with water for best effect.
7. Allow pace tattoo to dry thoroughly before running.
8. Do not apply sunscreen directly onto pace tattoo To Remove: Saturate pace tattoo with rubbing alcohol or baby oil; wait 30 seconds, then rub away with cotton ball or lift Pace tattoo from dry skin using transparent tape.

WARNING: Do not apply to sensitive skin or near eyes.

In this example, a second layer is comprised of a water-soluble coating such as polyvinyl alcohol (PVOH) (32). A third layer (34) includes an adhesive deadener that is preferably pressure sensitive and hypoallergenic and is coated in an ethyl alcohol solution of polyvinyl alcohol. This layer (34) is provided so that the temporary tattoo has no tack on its outer surface when it is applied to the skin. Tackiness on the outer surface is undesirable because it can reduce the life and quality of the temporary tattoo once applied. A fourth layer (36) comprises a tattoo design printed preferably with food grade inks that can be printed by offset, silk screen, or gravure. In most commercial temporary tattoo applications offset printing methods are employed. The colorants used in the inks comprising the tattoo design (36) preferably should meet the same requirements governed by the Food and Drug Administration (FDA) for food, drug, and cosmetic colorants. The inks can be pigmented and solvent based so that they are not degraded by artificial or sun light. A fifth layer includes (38) includes a pressure sensitive adhesive (38) comprised of an acrylic copolymer. A sixth layer (40) is preferably a release layer comprised of either silicon or quilon and is applied on top of the tattoo design layer (36). Finally, a protective sheet (42) that can be comprised of polyester, poly vinyl chloride, polypropylene; tag, kraft, or parchment paper is applied to protect the product. In the preferred embodiment the protective sheet (42) is transparent so that the design in the design layer (36) can be identified or read, albeit, in reverse form as indicated above.

To apply the preferred embodiment of the temporary tattoo (10) described above, the user removes the protective sheet (42) and release coating (40) and presses the pressure adhesive layer (38) to the skin. Next, water is applied to the outer side of the uncoated paper layer (30). Water is transmitted through the uncoated paper layer (30), dissolving the water-soluble coating (32) allowing the tattoo design to be transferred to the skin.

Figure 4:
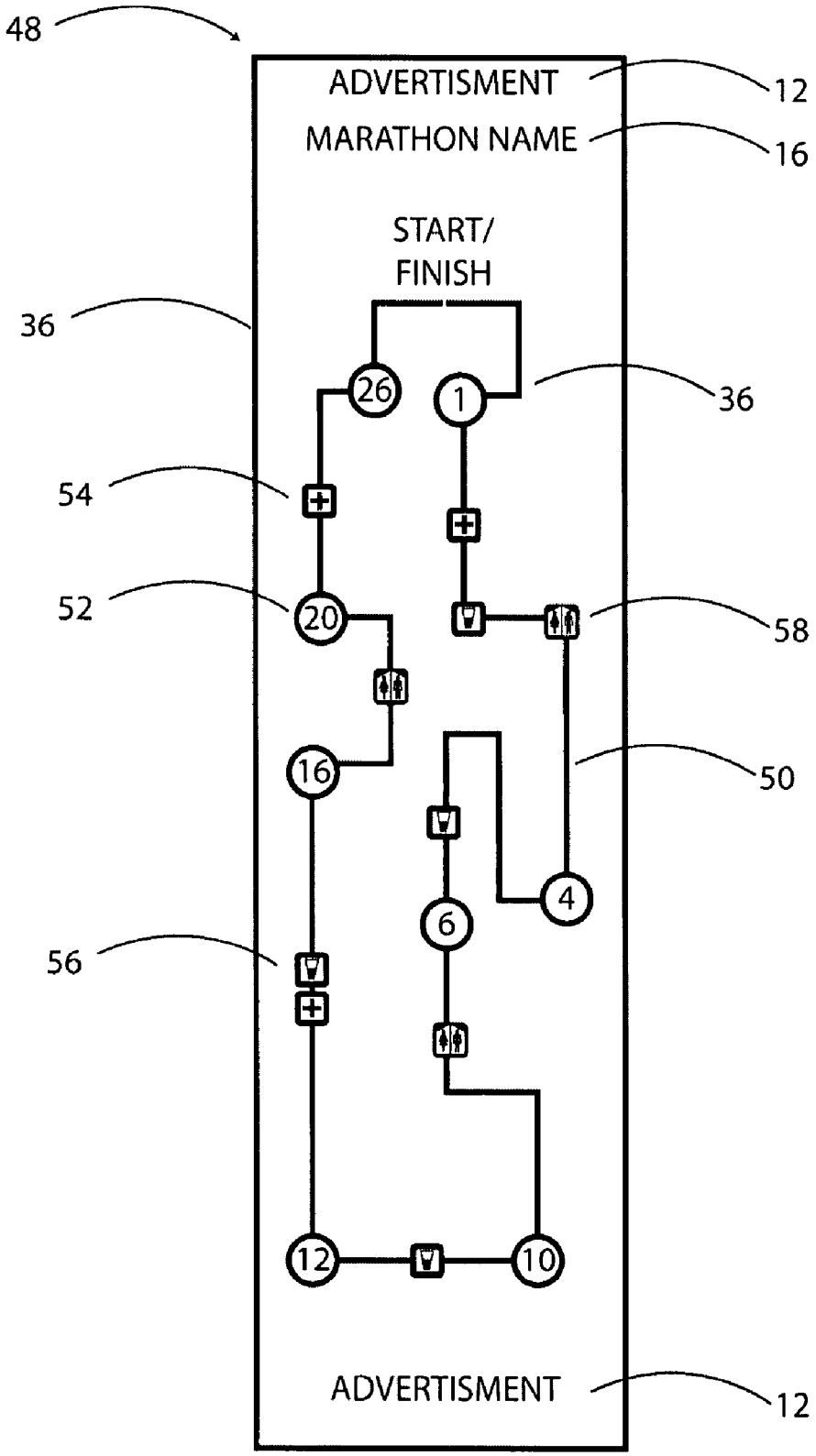
FIG. 4 is a plan view of the described product and method in accordance with the present disclosure displaying a course map as it can appear as applied on a person's skin.

Another embodiment of the described product and method can include a design showing a course map (50) for a particular event, generally indicated by (48) in FIG. 4. This embodiment can also include areas for advertising (12) and event information (16). The locations for advertising (12) and event information (16) need not be restricted to the areas indicated in FIG. 4. In this example, a course map (50) can be shown that enables the athlete to determine his or her location on a course. Mile markers (52), aid stations (54), water stops (56), and toilets (58) can also be indicated on the course map (50). Other pertinent landmarks can also be included in this embodiment.

Figure 5:
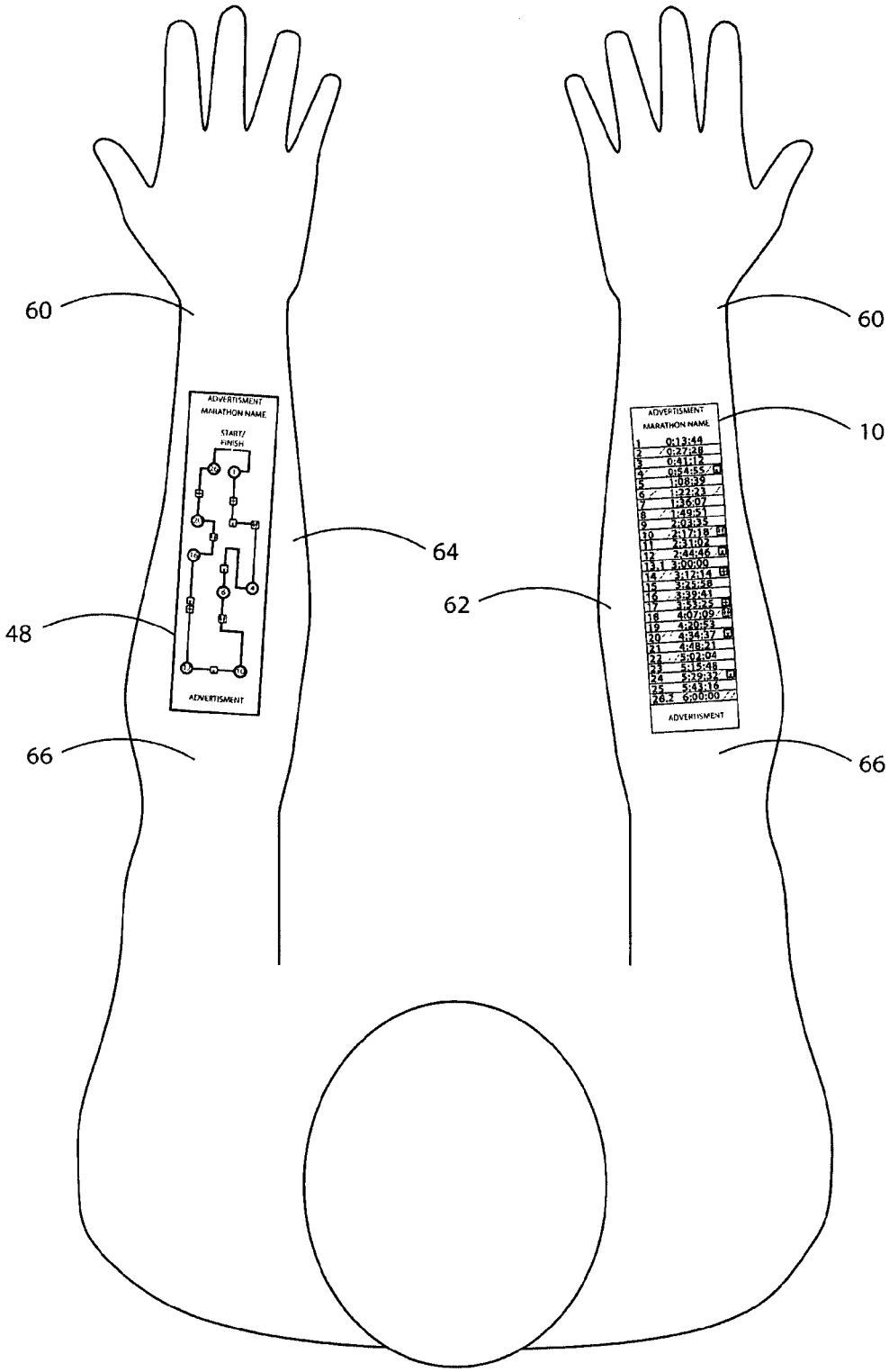
FIG. 5 is a schematic view showing the placement of the described product on the forearms of an athlete.

FIG. 5 shows a schematic representation of the transferred designs of the marathon pace embodiment (10) and the course map embodiment (48) on the inner surfaces of an athlete's right (62) and left (64) forearms respectively. FIG. 5 shows a preferred orientation, shape, and size that facilitate reading the displayed race information. The orientation of the transferred designs (10) and (48) can be advantageously placed on the inner surfaces of the forearms (62) and (64) between the wrists (60) and the elbows (66). The shape and size of the described product is generally rectangular with longitudinal sides approximately 6.5 inches long with a width of approximately 1.5 inches. Such shape, size, and orientation being advantageous for displaying and reading a maximum amount of race information while an athlete is performing an athletic activity. The described product and method is not restricted to the placement being disclosed. Athletes can choose any other location or orientation that facilitates their needs for a particular activity.

Those skilled in the art will be familiar with this and other methods that comprise a temporary tattoo. Any existing method for creating temporary tattoos can be applicable in manufacturing the described product.

Subsequent to the completion of an event, the temporary tattoo can be removed using soap and water or a solvent such as rubbing alcohol. The temporary tattoo can also naturally degrade over the course of time and will begin to lose adhesion to the skin.

Figure 6:
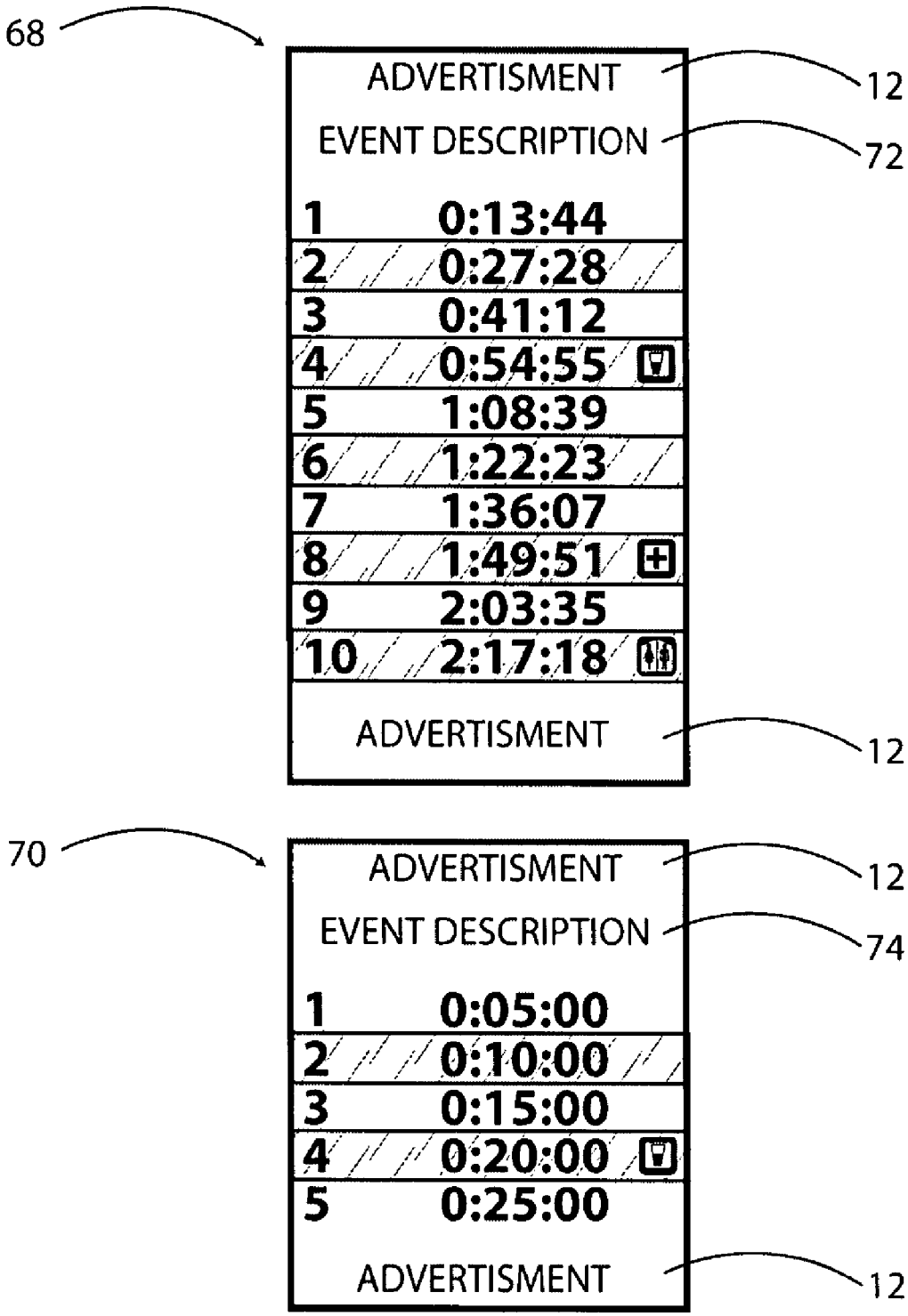
FIG. 6 is a plan view of described product and method in accordance with the present disclosure to be used in a multi-sport event as it can appear as applied on a person's skin.

Another embodiment of the described product and method can include a design utilizing separate segments for different events in a multi-event race such as a duathlon generally indicated by (68) and (70) in FIG. 6.

This embodiment can include areas for advertising (12) and event information (72) and (74). The locations for advertising (12) and event information (72) and (74) need not be restricted to the areas indicated in FIG. 6. An example of an event where this embodiment can be advantageous is a duathlon where participants compete in biking and running segments. Participants can select the described product for each event according to his or her desired pace for that segment. It should be noted that the multi-event race can be combined in a single tattoo rather than the two separate tattoos (68) and (70) shown in FIG. 6.

Having described the preferred embodiment of a temporary tattoo, the same information can be displayed in another embodiment using a sticker that is comprised of a substrate designed to have the same flexibility and resiliency properties as the temporary tattoo and an adhesive used to apply the sticker to human skin. Those skilled in the art are familiar with certain types of adhesives that can be used that adhere well to human skin that can be advantageous to such an embodiment. An adhesive such as 3M 1522—a hypoallergenic, pressure sensitive, acrylate adhesive can be used along with a polyethylene backing on which race information can be printed. Such an embodiment can be resistant to water, perspiration, and light abrasion. Subsequent to the completion of an event, the sticker can be removed by peeling from the skin.

As previously described and illustrated in the accompanying figures, the present disclosure presents a product and method for displaying on an athlete's skin event information useful to an athlete during performance of the event and in particular event parameter data such as pace data or a course depiction. One of the advantages of the product as described above is that it is readily possible to, for example, produce sets of pace displays such as (10) shown in FIG. 1, for different paces. Thus, athletes can select a tattoo, for example, having the desired pace. It will be understood that the described product and method is not limited to the preferred embodiments described above since other embodiments and modifications can be obvious to those skilled in the art.

I claim:

1. A method of providing event information to an athlete in an athletic event comprising the steps of:

providing multiple sets of information displays, each said set of information displays including a plurality of adhesive layers secured to a corresponding plurality of display layers wherein the display layers in each said set of information displays include elapsed time data for a predetermined pace relating to the event, and each second set of information displays includes elapsed time data for a different pace;

selecting a said information display from one of said sets of information displays based upon a desired pace;

applying said information display to the skin of the inner portion of one of the forearms of the athlete prior to the event utilizing said adhesive;

utilizing the event parameter data during the event; and removing said information display from the athlete's forearm after the event, wherein said event is a race.

2. The method of claim 1, wherein said multiple sets of information displays further comprise event parameter data including a depiction of a course of the event.

3. The method of claim 1, wherein said plurality of display layers additionally includes printed advertising or event promotional information.

4. The method of claim 1, wherein the athletic event is a race and each display further comprising event parameter data printed in a plurality of segments and each of said segments includes elapsed time data for a predetermined distance for a predetermined pace of said race.

5. The method of claim 4 wherein at least one of said predetermined segments includes a printed symbol representing a support station.

6. The method of claim 1, wherein the athletic event is a race and each display further comprising event parameter data that includes a course map including the location of mile markers.

7. The method of claim 1 wherein a first side of each display is configured so that the display can be affixed to substantially the length of the inner surface of the athlete's forearm.

8. The method of claim 1 wherein said adhesive layers includes an acrylic copolymer or a pressure sensitive acrylate.

9. The method of claim 1 wherein said information display is a temporary tattoo and said step of applying said information display includes removing a protective sheet and a release coating from said tattoo, pressing said adhesive layer to the skin of the forearm and transferring said event parameter data on said display layer to the skin.

10. The method of claim 1 additionally including the steps of providing a course information display that includes an adhesive layer secured to a display layer wherein the display layer includes printed depiction of the race course, applying said course information display layer to the skin of the other forearm using said adhesive prior to the race, and removing said course display layer from the athlete's other forearm after the race.

11. The method of claim 1 wherein the event includes two segments and the first segment is a race, and additionally including the steps of providing a second segment information display that includes an adhesive layer secured to a second segment display layer wherein said second segment display layer includes a printed second set of event parameter data, applying said second segment display layer to the skin of one of the athlete's forearms using said adhesive prior to the event, and removing said second segment display layer from the athlete's other forearm after the event.

* * * * *